US006092349A

United States Patent [19]

Trenerry

[11] Patent Number: 6,092,349

[45] **Date of Patent: *Jul. 25, 2000**

[54] ELONGATE STRUCTURAL MEMBER

[76] Inventor: John Allan Trenerry, 143 Kissing Point Road, Dundas, NSW, 2217, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/930,469

[22] PCT Filed: Mar. 22, 1996

[86] PCT No.: PCT/AU96/00160

§ 371 Date: Nov. 24, 1997

§ 102(e) Date: Nov. 24, 1997

[30] Foreign Application Priority Data

Mar. 22, 1995 [AU] Australia ..... PN1860

[51] Int. Cl.[7] ..... E04C 3/32

[52] U.S. Cl. ..... 52/730.6; 52/731.7; 52/733.2

[58] Field of Search ..... 52/729.3, 730.6, 52/731.7, 740.3, 481.1, 783.11, 733.2

[56] References Cited

U.S. PATENT DOCUMENTS 3,805,471 4/1974 De Schutter ..... 52/481.1 X 5,592,796 1/1997 Landers ..... 52/481.1 X

FOREIGN PATENT DOCUMENTS

| | | |
|---|---|---|
| 5340273 | 9/1974 | Australia . |
| 4114778 | 5/1980 | Australia . |
| 608099 | 6/1989 | Australia . |
| 5716990 | 12/1990 | Australia . |
| 5207493 | 6/1994 | Australia . |
| 2451486 | 10/1980 | France . |
| 855146 | 8/1981 | U.S.S.R. . |
| 989027 | 4/1965 | United Kingdom . |
| 1590377 | 6/1981 | United Kingdom . |
| 2140478 | 11/1984 | United Kingdom . |

*Primary Examiner*—Christopher T. Kent
*Attorney, Agent, or Firm*—Edwin D. Schindler

[57] ABSTRACT

An elongate structural wall frame member having a substantially uniform material gauge has at least one web element and at least one flange element. The flange element has a plurality of corrugations as stiffeners in the longitudinal direction of the member. The corrugations are equally spaced and are formed at least in the flange element, with no corrugations being located in a longitudinal direction at, adjacent to, a centerline of a web element.

13 Claims, 3 Drawing Sheets

ELONGATE STRUCTURAL MEMBER

The present invention relates to improvements in elongate structural members for use in structural frameworks and, in particular, to steel structural members which are preferably cold formed by roll forming sheet metal, and which have a plurality of corrugations formed in the flange(s) to provide material concentration at the extremities of the transverse cross section of the member, thus resulting in greater average material thickness on the flange(s) while the average material thickness of the web(s) remains the same as the gauge of the rolled sheet metal. In a further preferred feature, the corrugations extend partially into the web(s).

BACKGROUND TO THE INVENTION

Prior art elongated structural members have inherent design inefficiencies due primarily to the roll forming process utilising a uniform material gauge to produce the structural member so that all the elements comprising the structural member have uniform material gauge. All structural members produced in this way comprise at least one web element and at least one flange element, for instance a known C-channel or section has one web element and two flange elements, although depending on the orientation of the section under design where the flanges are in a vertical orientation, this section will comprise one flange and two webs. A known top hat section has two web elements and three flange elements, all these sections may be structurally improved by incorporating lip stiffening elements to the free end of the web or flange elements of the lipped Z-section member 1 as illustrated in FIG. 1.

Known sections such as boxed C-sections, which are manufactured and which through the nature of boxing achieve doubling of the material in the tube flanges with single gauge material in the webs. The effect of this boxing results in increased torsional strength dependent on the boxing closing mechanism and flange stability, but no increase in structural design efficiencies of the component C-sections is achieved.

Roll formed sections are generally manufactured from a coil of uniform gauge, therefore conventional design methods dictate the geometry of the section, that is, for a particular material gauge there are geometric constraints on the lengths of webs and flanges which comprise the section. In some cases additional stiffening may be required in the section element where basic element width to thickness ratios are exceeded in relation to the design calculations for both strength and deflection. These stiffening elements have known governing design rules and may take many different forms although it is conventional to locate a stiffener centrally within the element and it normally takes the simple V-form. The design philosophy used in the application of stiffeners is to maximise the design efficiency of the particular plate element in an attempt to maximise the design efficiency of the whole section comprising these plate elements. The inclusion of a stiffener has previously been considered when there is a geometric deficiency in the plate element and in general the number of stiffeners in any one element is minimised. Normally the commercially available sections especially Z and C purlins and top hats have no stiffening elements.

The two aspects in the design philosophy of economical and material efficient sections are maximising strength to weight ratio and minimising deflection to weight ratio, ie maximising the second moment of area and minimising the material content. The strength requirement can be maximised by the addition of stiffening elements in the usual way. The flanges of such designed sections normally provide the greatest contribution to the second moment of area $I_{aa}$ By making the section deeper by extending the length of the web, the $I_{aa}$ can be substantially increased whilst maintaining the same material gauge. In a like manner, by increasing the material gauge whilst keeping the overall section shape the same, a linear increase in the section property $I_{aa}$ can be achieved. Both of these methods result in design and material inefficiencies because the sections are formed from a uniform thickness coil.

Using known types of elongate structural members, the depth of the section is limited by the code design requirement of the web depth to material thickness ratio which addresses the ability of the slender web to withstand bending stresses and crushing or bearing loads. The additional material in the web does not contribute substantially to the $I_{aa}$ (which is about a plane perpendicular to the web) of the entire section member.

There are also known boxed sections where the gauge of the web material is thinner than that forming the flanges. These types of boxed sections are excessively difficult to manufacture in roll forming and joining four separate cold formed sections together.

It is seen that in the design of thin gauge cold formed sections that stiffening elements in the flanges and webs are normally employed to maximise the design efficiency in relation to strength. These stiffeners resist local buckling of the plate elements and thus tend to maximise the uniform distribution of stresses across the plate element and maintain uniform section properties under applied loading. The incorporation and design of these stiffeners is covered in design standards.

Therefore it is seen that there is a need to provide a design feature for plate elements in structural members which maximises the second moment of area of the section to material content ratio using a single gauge coil.

OBJECT OF THE INVENTION

Therefore it is the object of the invention to provide an elongate structural member having a substantially uniform material gauge, which substantially overcomes or ameliorates the above mentioned disadvantages with known structural members. At the very least the object of the present invention is to provide an alternative to known structural members.

DISCLOSURE OF THE INVENTION

According to one aspect of the present invention there is provided an elongate structural member having a substantially uniform material gauge, said member comprising at least one web element and at least one flange element, wherein each said member has a means for stiffening in the longitudinal direction of said member, said means comprising a plurality of corrugations being a plurality of stiffeners equally spaced and being formed at least in the flange element and wherein said at least one web element does not have said corrugations located at or adjacent its centreline in its longitudinal direction.

In one preferred form the plurality of corrugations extend in the longitudinal direction along the longitudinal extent of the member and are formed at least partially across the width of the flange element Preferably, the plurality of corrugations formed in the flange element extend across the entire width of the flange.

In another preferred form the plurality of corrugations extend partially across the web element at the extremities of the transverse cross section of the web element, where the stresses are greater.

In a other preferred forms the member comprises two flange elements and one web element, the member being formed as a C-channel; two flange elements and one web element, the member being formed as a Z-channel, three flange elements and two web elements, the member being formed as a top hat section.

In a further preferred form the free edge of the flange element has a lip having extending therealong an additional stiffener function.

Preferably the plurality of corrugations are rounded and/or substantially semi-circular and have internal bend radii of 0.2 mm to 18 mm. In other preferred forms, the ratio of the internal bend radii to the thickness of the material is less than 4.0 to 1.0.

In a further preferred form a nail support means results from deformation of material in a groove of said corrugations when a nail penetrates therein when said nail radius is greater than the bend radius of said corrugations by ratio 1.0 to 2.0.

Preferably the Member is cold rolled from sheet metal, extruded or hot rolled from sheet metal.

BRIEF DESCRIPTION OF THE DRAWINGS

Some embodiments of the present invention will now be described with reference to the drawings in which;

FIG. 4(*b*) is a plan view of the nail penetration of FIG. 4(*a*).

BEST MODE OF CARRYING OUT THE INVENTION

Figure 1:
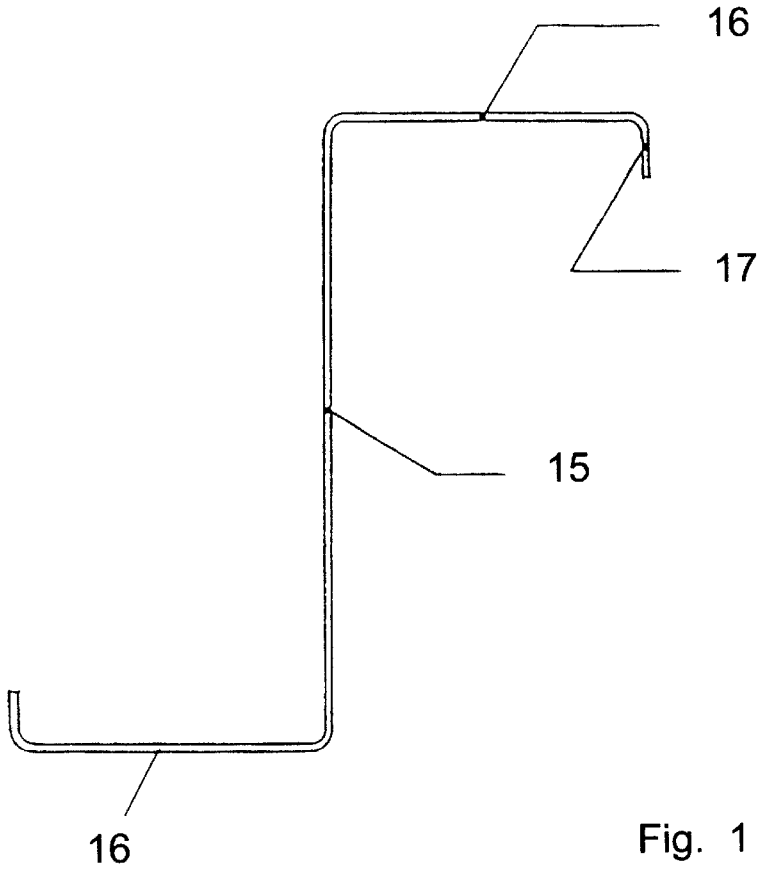
FIG. 1 is a sectional view of a prior art Z-section member having lip stiffeners at the free edge of the flanges.

Typical embodiments of the present invention are shown in FIGS. 2(*a*)–(*d*) showing cross sectional views of the elongate members of the present invention, including a lipped Z-section member 11, a Upped C-section member 12, an unlipped C-section member 13 and a top hat section 14 respectively. Each member 11, 12, 13, 14 have at least one web element 15 and at east one flange element 16 which are at right angles to each other. For example, the Z-section member 11 has a single web element 15 with two flange elements 16 extending from either end of the web element 15 in opposite directions with a lip 17 at right angles to end of the flange element 16, the lipped C-section member 12 has a single web element 15 with two flange elements 16 extending from either end of the web element 15 in the same direction with a lip 17 at right angles to the flange element 16, an unlipped C-section member 13 as described above having no lips, and the top hat section 14 has two parallel web elements 15 with three flange elements 16, one extending between the two parallel web elements 15 at one end thereof and the other two extending from the ends of the two parallel web elements 15 in opposite directions.

These four embodiments are only examples of typical sections, and it is obvious to those skilled in the art that there are a number of variations of the elongate members, including a simple angle section which includes a single web element and a single flange element at an angle thereto. It is noted that the web and flange elements 16, 17 do not have to be at 90 degrees to each other but can be at any desirable angle.

The flange elements 16 of each of the members 11, 12, 13, 14, have corrugations 20 extending in the longitudinal direction along the longitudinal extent of the member, the corrugations 20 acting as a number of stiffeners. The corrugations 20 result in a greater material concentration at the flange elements 16 and therefore at the extremity of the section (within the overall section dimensions). This results in a greater average material thickness in the flange elements 16 as compared to the average material thickness in the web elements 15. The members 11, 12, 13, 14 are preferably cold formed by roll forming a sheet or roll of uniform gauge metal. It is within the scope of the invention for the members 11, 12, 13, 14 to be formed by extrusion, pressing, hot rolling or the like. The material of the members is not restricted to ferrous metals, but can include non-ferrous metals, plastics, fiberglass and other suitable materials.

It is seen form FIGS. 2(*a*)–(*d*) that the corrugations 20 are formed across the width of the flange elements 16 and can extend, as shown in FIGS. (*a*)–(*c*), partially across the web elements 15 at the extremities of the web elements 15 where the stresses are greater. These corrugations 20 also reduce the unstiffened length of the web elements 15 to suit design code requirements. In this case the average material thickness of the web elements 5 is greater than the thickness of the sheet or coil material if so thus formed.

It is also within the scope of the present invention for the corrugations 20 to be formed only partially across the width of the flange elements 16 and partially along the longitudinal extent of the elongate member. It is also within the scope of the present invention for the corrugations 20 to be at an angle to the longitudinal direction of the elongate member.

When the members 11, 12, 13, 14, are formed by cold rolling, the corrugations and therefore the element in which they are situated is work hardened. In the case where the corrugations 20 extend the entire width of the flange elements 16, the entire flange elements 16 are hardened and where the corrugations continue into the web elements 15, then work hardening results in material of higher yield strengths where the stresses are greatest. This allows for the use of lower grade steels, eg G300, as the base material and where it is necessary, this base can be work hardened to give higher strength material where it is required. In using high strength steel, eg G500, as the base, an increase in strength (for a comparable section) is achieved, however inefficiencies exist as previously described with respect to the thickness of the material.

When determining the bend radii of the corrugations 20 of the present invention, use is made of known design parameters used in the design of conventional stiffeners. It is normal design practice to design a conventional flange stiffener to have a minimum section property and bend radii which correspond to radius/thickness ratios of known values (dependent on the material yield stress, thickness and coating class) so that the section resists local plate buckling, cracking of the high tensile material, and tearing of the coating, respectively. The present invention includes within its scope, the application of these known ratios used in the design of conventional stiffeners, to the design in maximising the density of the corrugations 20 in a plate element.

Figure 3:
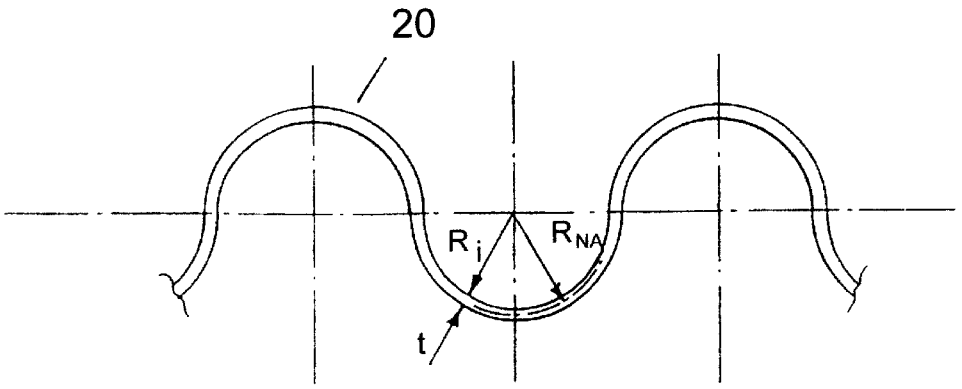
FIG. 3 is a partial cross section view of the corrugations of a preferred embodiment as shown in FIGS. 2(*a*)–(*d*)
Figure 2A:
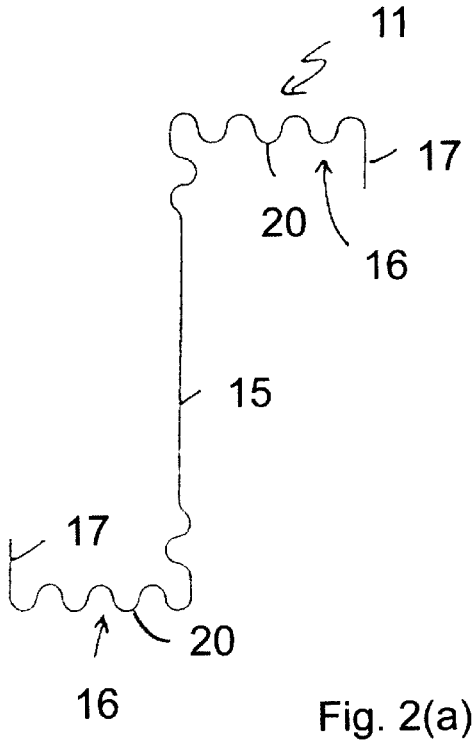
FIGS. 2(*a*)–2(*d*) are schematic cross sectional views of typical embodiments of the invention in conventional section shapes, with the feature of the present invention shown therein.
Figure 2B:
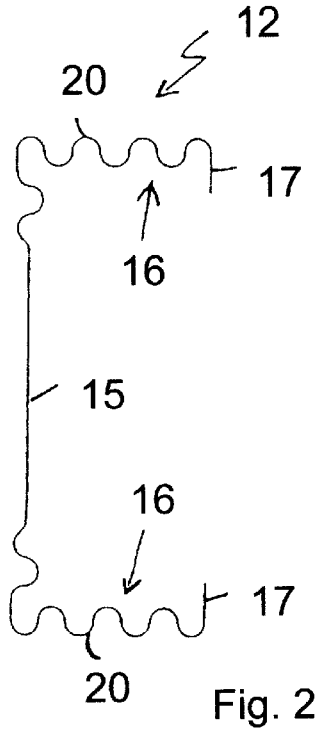
Figure 2C:
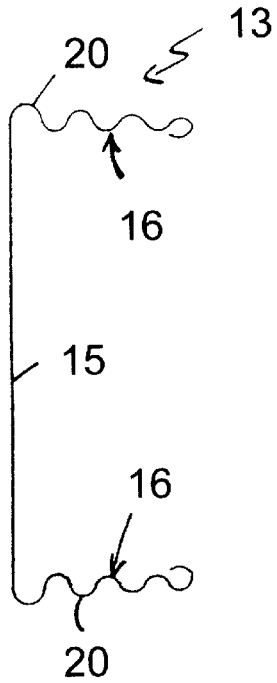
Figure 2D:
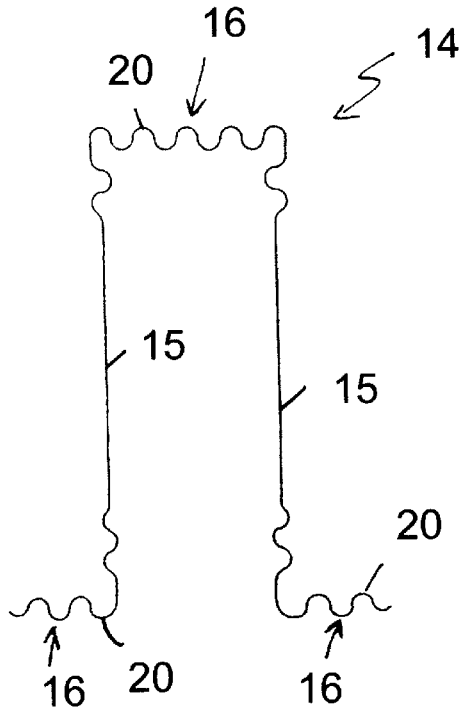

In the design of the lipped C-section member 12 with the dimensions of 100 mm web element and 50 mm flange element 16, ie 100×50, as shown in FIG. 2(*b*) with particular regard to FIG. 3, it is seen from the following table that as the yield strength of the material increases, the allowable bend radii also increases thus lowering the density of the corrugations 20. It is seen from the table that when the bend radii is smaller and hence the density of the corrugations 20 is increased, the improvement in the material efficiency is greater than when the density is low.

Analysis has shown the following:

| Fy MPa | t mm | $R_{NA}$ mm | $I_{aa}/A$ mm2 | $I_{aacorrugated}/A$ mm2 | % Improvement |
|---|---|---|---|---|---|
| 350 | 0.5 | 0.87 | 1125 | 1380 | 23 |
| 550 | 0.5 | 3.6 | 1125 | 1194 | 6 |

Fy = yield strength
t = base material thickness
$R_{NA}$ = corrected minimum bend radius for corrugation property calculation in the material neutral axis
$I_{aa}/A$ = Uncorrugated section property to total section area ratio (measure of material efficiency)
$I_{aacorrugated}/A$ = Corrugated section property to total section area ratio.

The corrugations 20 are preferably rounded and/or substantially semicircular in shape and have bend radii in the range of 0.2 to 18 mm. This range depends on the thickness of the material and the ratio of the internal bend radii to the thickness of the material is preferably less than 4.0 to 1.0 based on design considerations.

It is conventional practice to fix sheathing in the form, for example, of roofing and wall linings (not illustrate) to typical C-sections, Z-sections and top hat sections using self drilling screws. This method of fixing is costly in both labour to install the screws and the cost of the screws. Nailing of sheathing to the structural member flanges is the most cost effective means of providing a connection but is difficult to achieve since these structural sections do not have the cross sectional geometry to allow penetration of the nail into two adjacent layers of the structural member so as to provide a means by which the nail shank is supported once the nail is installed. The penetration of the nail into only one layer of material albeit the flange, especially formed from light gauge material, will allow the nail to roll against the edges of the penetration in any direction in the plane perpendicular to the shank of the nail which will reduce the nail's effectiveness. Therefore it is seen that it is advantageous and within the scope of the invention is to provide a means of nail shank support when it is nailed into a structural member by using the corrugations with a formed bend radius which is sized to suit nail cross sectional diameters.

Figure 4B:
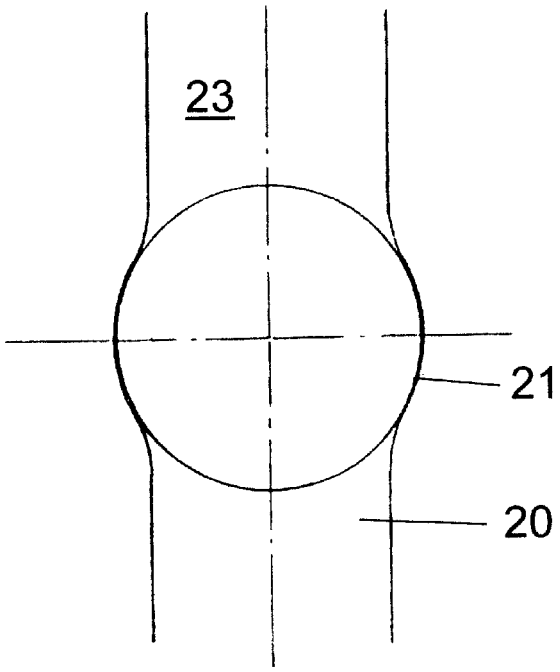
FIG. 4(*a*) is a partial end elevational view of nail penetration of the corrugations.
Figure 4A:
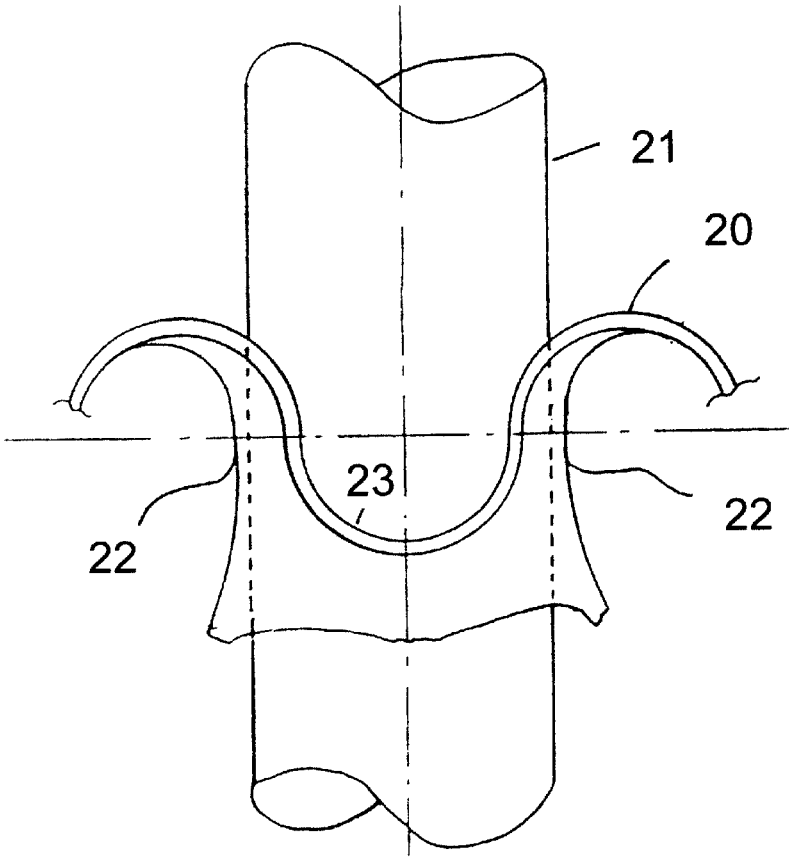

For example, a nail 21 as illustrated in FIGS. 4(*a*) and (*b*) with OD of 2.8 mm will form a nail support 22 within a groove 23 of the corrugations 20, where the groove radius is 1.4 mm or less. Likewise another standard gauge nail of 3.75 mm will form the nail support 22 in the groove 23 with a groove radius of approximately 1.9 mm or less. The nail support 22 is achieved in the plane perpendicular to the shank axis of the nail 21 primarily in the direction perpendicular to the longitudinal axis of the corrugations 20 and to vowing degrees by the deformation of the sides of the corrugations 20 in contact with the nail shank in the direction parallel to the corrugations 20. The former is the more important support especially in the installation of vertical wall metal cladding, for example, since the weight of the cladding requires vertical support from the nail 21 so that the cladding will remain in situ. This direction corresponds to the orientation of the corrugations 20 in the structural member, the corrugations 20 being transverse to the lay of any cladding which may be fixed thereon.

Roof sheeting (not illustrated) is normally fixed to roof purlins (not illustrated) using self drilling screws and it is conventional practice to install the screws through the centre of the crest of the roof cladding into the purlin. Crest fixing allows the fastener to rotate under the expansion and contraction effect of the cladding and also acts to preserve a connection which is water impervious. While nailing into the pan of the roof cladding may provide connection adequacy in terms of strength, it is difficult to achieve a water tight connection and the expansion and contraction effects will elongate the nail penetration in the cladding, thus further reducing the effectiveness of a water seal. Therefore it is seen that it is advantageous and within the scope of the invention is to provide a means by which roof cladding can be crest fixed using nailing and this is achieved by the corrugations 20 providing nail support in the direction of the cladding expansion and contraction movement whereby the flange 16 of the supporting structural member can rotate along with nail rotation.

The foregoing describes only some embodiments of the invention and modifications obvious to those skilled in the art can be made thereto without departing from the scope of the present invention.

What is claimed is:

1. An elongate structural member having a substantially uniform material gauge, said member comprising at least one web element and at least one flange element, wherein said member has a means for stiffening in the longitudinal direction of said member, said means comprising a plurality of corrugations being a plurality of stiffeners contiguous one another and formed in an opposite direction relative to a contiguous stiffener, without there being a flat spacing between said contiguous stiffeners, said plurality of stiffeners being formed at least in the at least one flange element and wherein said at least one web element does not have corrugations located at or adjacent a centerline of said at least one web element in a longitudinal direction of said at least one web element, said plurality of corrugations in the at least one flange element resulting in a maximization of a second moment of area for said elongate structural member.

2. The elongate structural member as claimed in claim 1, wherein said plurality of corrugations extend in the longitudinal direction along the longitudinal extent of said member and are formed at least partially across a width of the flange element.

3. The elongate structural member as claimed in claim 2, wherein the plurality of corrugations formed in the flange element extend entirely across the width of the flange element.

4. The elongate structural member as claimed in claim 3, wherein the plurality of corrugations extend partially across the web element adjacent the flange element.

5. The elongate structural member as claimed in claim 1, wherein the member comprises two flange elements and one web element, said member being formed as a "C" channel.

6. The elongate structural member as claimed in claim 1, wherein the member comprises two flange elements and one web element, said member being formed as a "Z" channel.

7. The elongate structural member as claimed in claim 1, wherein the member comprises three flange elements and two web elements, said member being formed as a top hat section.

8. The elongate structural member as claimed in claim 1, wherein the free edge of the flange element has a lip having extending therealong an additional stiffener function.

9. The elongate structural member as claimed in claim 2, wherein said plurality of corrugations are rounded.

10. The elongate structural member as claimed in claim 2, wherein said plurality of corrugations are substantially semi-circular and have bend radii of 0.2 to 18 mm.

11. The elongate structural member as claimed in claim 2, wherein said plurality of corrugations are substantially semi-circular and have bend radii to thickness of material ratio of less than 4 to 1.

12. The elongate structural member as claimed in claim 1, wherein the member is cold rolled sheet metal.

13. The elongate structural member as claimed in claim 1, wherein the member is an extruded member.

* * * * *